US005666731A

United States Patent [19]

Rungren

[11] Patent Number: 5,666,731

[45] Date of Patent: Sep. 16, 1997

[54] OPENING DEVICE FOR PLASTIC PACKAGES

[75] Inventor: Bret A. Rungren, Ventura, Calif.

[73] Assignee: Mike B. Lynch, Ovideo, Fla.; a part interest

[21] Appl. No.: 664,026

[22] Filed: May 23, 1996

Related U.S. Application Data

[63] Continuation of Ser. No. 363,756, Dec. 23, 1994, abandoned.

[51] Int. Cl.[6] ..... B26B 29/06

[52] U.S. Cl. ..... 30/287; 30/2; 30/289; 30/294; 30/299; 30/DIG. 3

[58] Field of Search ..... 30/2, 278, 279.2, 30/279.6, 280, 286, 294, 314, 289, DIG. 3, 1, 287, 299

[56] References Cited

U.S. PATENT DOCUMENTS

| | | | |
|---|---|---|---|
| 802,909 | 10/1905 | Brisacher | 30/294 |
| 1,105,182 | 7/1914 | Caspers et al. | 30/2 |
| 2,442,694 | 6/1948 | Keiser | 30/289 |
| 2,662,283 | 12/1953 | Gienger | 30/280 X |
| 3,383,768 | 5/1968 | Hamilton | 30/294 X |
| 3,791,014 | 2/1974 | Perna | 30/294 |
| 4,001,934 | 1/1977 | Bell | 30/289 X |
| 5,333,381 | 8/1994 | Gelardi et al. | 30/2 |
| 5,555,624 | 9/1996 | McCracken | 30/2 |

FOREIGN PATENT DOCUMENTS

| | | |
|---|---|---|
| 737004 | 5/1943 | Germany . |

*Primary Examiner*—Rinaldi I. Rada
*Assistant Examiner*—Clark F. Dexter
*Attorney, Agent, or Firm*—Gene W. Arant

[57] ABSTRACT

A hand held device for cutting through shrink-wrapped packaging surrounding a package such as a compact disc case, which will allow the user to more easily remove the compact disc case from the packaging. The hand held device includes a cutting blade sized to cut through shrink-wrapped packaging of a predetermined thickness, and a holder for guiding its movement.

6 Claims, 1 Drawing Sheet

OPENING DEVICE FOR PLASTIC PACKAGES

This is a continuation of application Ser. No. 08/363,756, filed Dec. 23, 1994, now abandoned.

BACKGROUND OF THE INVENTION

It is presently an accepted commercial practice to sell Compact Discs (C.D.'s) and cassette tapes in shrink-wrapped packages. The plastic sheet material used in the shrink-wrap process is very thin, but nevertheless strong and tough.

Such packages normally have a side wall, an openable lid that closes against a longitudinal edge of the side wall, and a sheet member covering the juncture of the lid and the longitudinal edge of the side wall. The sheet member is part of the shrink wrapping that encloses the entire package. This plastic shrink-wrap packaging is extremely difficult to remove. A security tab is generally also provided over the openable end of the case and underneath the shrink wrap, which is just as difficult to remove. Not only has it been very inconvenient for customers to open these packages, but in some instances injury to the person or damage to the contents of the package has occurred.

SUMMARY OF THE INVENTION

The present invention provides an opening device that is especially adapted for opening shrink-wrapped CD or cassette packages. It consists of a small block that may be held in the hand of a person, having a longitudinally extending slot formed in one of its sides. The width of the slot is slightly greater than the thickness of the package to be opened, so that a side of the package may be slid longitudinally through the slot. A cutting blade is secured in the bottom wall of the slot, extending parallel to the side walls of the slot so as to make a lengthwise cut in the shrink wrapping of the package as one side of the package is slid through the slot.

In its presently preferred form the invention provides two separate slots in the block, the widths of the slots being adapted to a CD package and a cassette package, respectively.

It is also preferred to provide a finger gripping surface on the block which makes it easier to grip the block, as well as aiding in its correct orientation.

Thus, the object of the present invention is to provide an opening device especially adapted for opening shrink-wrapped CD or cassette packages, which is safe and convenient to use as well as inexpensive to manufacture.

DRAWING SUMMARY

DESCRIPTION OF PREFERRED EMBODIMENT (FIGS. 1 through 8)

Figure 1:
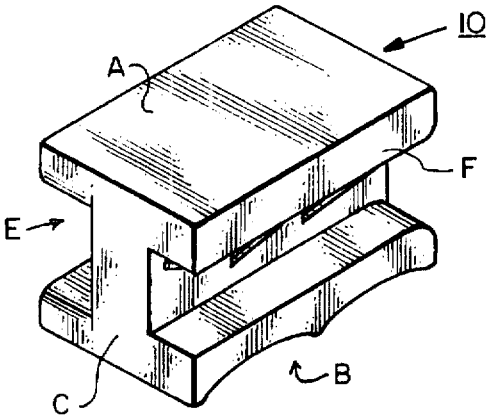
FIG. 1 is an isometric top view of the presently preferred form of my invention.

Referring now to the drawings, my novel OPENING DEVICE FOR PLASTIC PACKAGES is designated generally by the numeral 10. As shown in FIG. 1, the top surface is designated by letter A; the bottom surface by letter B; the front end by letter C; the rear end by letter D; the left side by letter E; and the right side by letter F.

My opening device 10 is preferably formed as a solid block of plastic material, with two separate blades partially submerged in the plastic material. In its presently preferred form the block is one inch wide, one inch high, and one and a half inches long. It has two longitudinally extending slots formed therein, namely, a slot 12 in the side face D for opening CDs, and a slot 14 in face E for opening cassette tapes.

Thus the slot 12 formed in the elongated face D has a bottom wall 20 and parallel side walls 22, 24. The slot 12 is of uniform width throughout its length, its width between the side walls 22, 24, being preferably about 7/16". Thus, its width is slightly greater than the thickness of a CD package so that a side of the package may be slid longitudinally through the slot 12. The package will enter slot 12 from the rear end face D and move toward the front end face C. An arrow 28 on the bottom wall 20 points toward the rear end wall D, indicating the end of the slot into which the package is to be inserted. Alternatively, it may be considered that the arrow 28 indicates the direction in which the opening device is to be moved when engaging the package. The side walls 22, 24 are rounded at their ends 22A, 24A, adjacent the rear end face D, to aid in guiding the CD package as it enters the slot.

A small cutting blade 26 is embedded in the bottom wall 20 of slot 12, rather near to the front end face C, protruding only about 1/16". Blade 26 may be seen in FIGS. 1, 3, 4, and 6, although only a small fragment of it appears in FIG. 1. The cutting edge of blade 26 faces away from front end C. This allows the package to become firmly guided by the walls 22, 24 of the slot before encountering the blade. Blade 26 is close to side wall 22, which insures optimum safety for the user.

The precise position of blade 26 relative to the inside wall 22 of the channel or slot 12 allows the blade to pierce the shrink wrap and slightly enter the otherwise closed mouth of the case. With the blade in this position, it is easily guided down the side of the case providing an uninterrupted incision in the shrink wrap for the entire length of the CD.

The slot 14 formed in the elongated face E has a bottom wall 30 and parallel side walls 32, 34. The slot 14 is of uniform width throughout its length, its width between the side walls 32, 34, being preferably about 5/8". Thus, its width is slightly greater than the thickness of a cassette package so that a side of the package may be slid longitudinally through the slot 14. The package will enter slot 14 from the front end face C and move toward the rear end face D. An arrow 38 on the bottom wall 30 points toward the front end wall C, indicating the end of the slot into which the package is to be inserted. The side walls 32, 34 are rounded at their ends 32A, 34A, adjacent the front end face C.

A small cutting blade 36 is embedded in the bottom wall 30 of slot 14, rather near to the rear end face D, protruding only about 1/16". Blade 36 may be seen in FIGS. 2, 3, 5, and 6, being most clearly visible in FIG. 2. Blade 36 is close to side wall 32, which insures optimum safety for the user. The cutting edge of blade 36 faces away from rear end D. This allows the package to become firmly guided by the walls 32, 34 of the slot before encountering the blade.

Figure 2:
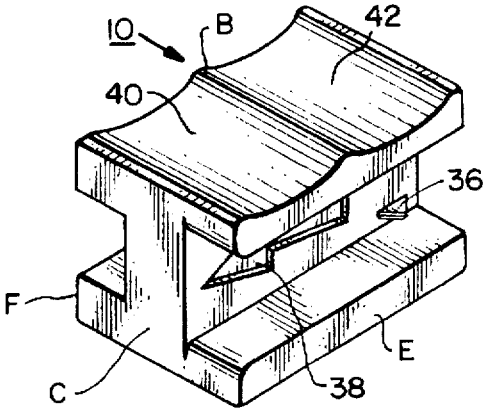
FIG. 2 is an isometric bottom view.
Figure 3:
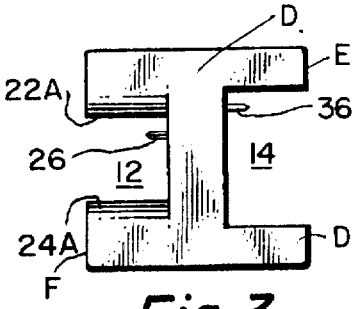
FIG. 3 is an end view of the rear end as seen in FIG. 1.
Figure 4:
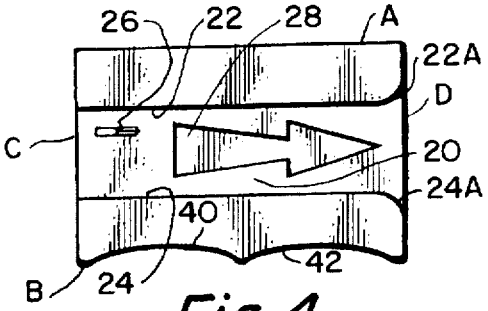
FIG. 4 is a side view taken from the right side of FIG. 1.
Figure 5:
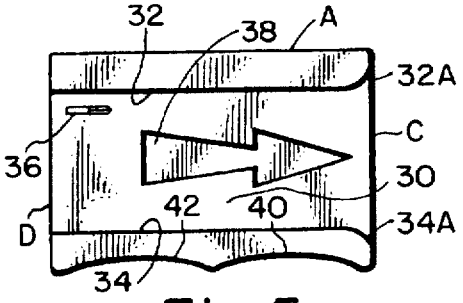
FIG. 5 is a side view taken from the left side of FIG. 1.
Figure 6:
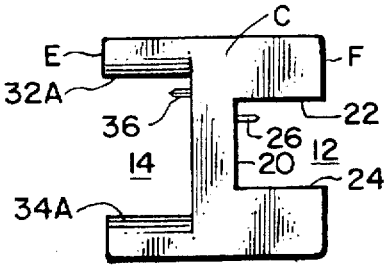
FIG. 6 is an end view of the front end as seen in FIG. 1.
Figure 7:
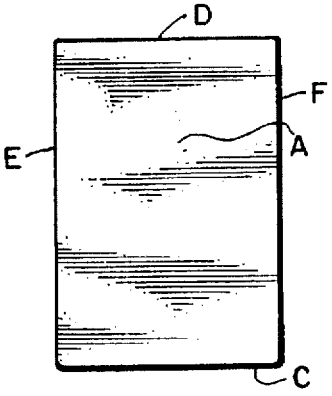
FIG. 7 is a top plan view.
Figure 8:
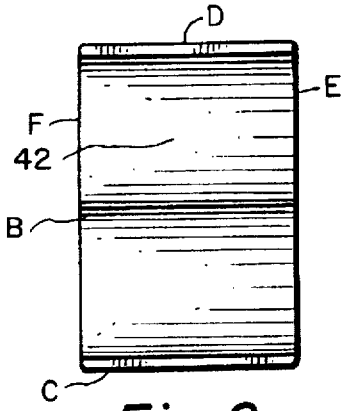
FIG. 8 is a bottom plan view.

An additional feature of the invention is that two finger recesses 40, 42 are formed in the bottom face B, as best seen in FIGS. 2, 4, and 5. These recesses not only make it easier to hold the device, but they also simplify the operation somewhat. Thus, if a right-handed person were going to open a tape cassette, he (or she) would place the opening device in the stance shown in FIG. 2 with side F (the narrow slot, for CD packages) nearest to himself, and the side E disposed away from himself. The thumb would be placed underneath top wall A (which is at the bottom of FIG. 2) and the middle finger and forefinger of the right hand would be placed in the recesses 40, 42. A downward movement of the right arm would then move the opening device 10 in the direction shown by arrow 38, to engage the package.

However, if a CD package were to be opened, he (or she) would place the opening device in the stance shown in FIG. 2 but with side E (the wide slot, for cassette packages) nearest to himself, and the side F disposed away from himself. The thumb would be placed underneath top wall A (which would again be the lowermost side) and the middle finger and forefinger of the right hand would be placed in the recesses 40, 42. A downward movement of the right arm would then move the opening device 10 in the direction shown by arrow 28, to engage the CD package.

Thus it will be seen that the finger recesses serve the useful function of helping the user of the device to very easily avoid two wrong positions for holding the product. A choice can then be made between the other two feasible positions, depending upon whether a CD package is to be opened or a cassette package is to be opened.

METHOD OF OPERATION

In accordance with the invention the method of opening a flat package which contains a recording medium, wherein the package has a side wall, wherein an openable lid that closes against a longitudinal edge of the side wall, and which contains a sheet member covering the juncture of the lid and the longitudinal edge of the side wall, includes the following steps. A cutting blade is inserted through the sheet member and also between the lid and the longitudinal edge of the side wall. A parallel pair of guide members (the walls of the associated slot) are placed in sandwich relation to the blade so that one engages the lid while the other engages the side wall of the package. The cutting blade is then supported from these guide members and the guide members are forcibly moved along the side wall of the package so that the blade continues to cut the sheet member and also creates a separation between the longitudinal edge of the side wall of the package and the openable lid of the package.

ALTERNATIVE FORMS

Although I presently prefer to incorporate into a single device the means for opening either a CD package or a cassette tape package, it will be evident that the product may be made in a modified form for only one of those purposes, in which case it may have only a single slot in only one of its sides.

While I prefer to make the opening device as a solid block of plastic material, other materials may be used, and in modified configurations, to accomplish the same result in the same way.

Although I have disclosed the presently preferred form of my invention in considerable detail in order to comply with the full disclosure requirements of the patent laws, it will be understood that the scope of the invention is to be limited only in accordance with the appended claims of invention.

What I claim is:

1. A hand held device for opening a selected one of two flat shrink-wrapped packages each of rectangular configuration and respectively different predetermined thicknesses, each package being characterized by a side wall having a longitudinal edge, an openable lid that closes against the longitudinal edge of the side wall, and a shrink wrapping enclosing the entire package, wherein the shrink wrapping includes a sheet member covering the juncture of the lid and the side wall edge, said device comprising:

a plastic block having elongated slots in two opposite sides which define a central wall portion therebetween, each slot having a bottom surface formed by the central wall portion and the bottom surface of each slot being essentially a flat plane, each slot having an opening side opposite said bottom surface and having an associated pair of side walls extending away from said central wall portion to a respective one of said opposite sides, said side walls being in a spaced parallel relationship;

each of said slots being of uniform width for slidably receiving a side of a respective one of said shrink-wrapped packages in close-fitting engagement therewith whereby the associated package may be slid longitudinally therethrough;

each of said slots having a respectively associated cutting blade secured in said bottom surface and extending parallel to the associated side walls of said slot for making a length-wise cut through the sheet member of the shrink wrapping, the cutting edges of the two blades being oriented longitudinally of their respective slots but in opposing directions therein; and each of said cutting blades being in a laterally offset position in its associated slot extending from said bottom surface to slightly enter the otherwise closed juncture of the lid and the longitudinal edge of the side wall of the selected package and thereby easily guide the blade to make an uninterrupted incision in the shrink wrapping through the entire length of the package.

2. The hand held device as in claim 1 wherein a third side includes a surface having recesses therein for finger gripping purposes, and a fourth side opposite said third side and having an essentially flat surface, the third and fourth sides being essentially parallel to both of said elongated slots, whereby the user of the device may very easily avoid two wrong positions for holding the device, and a choice can then be made between the feasible positions depending upon whether the shrink-wrapped package to be opened is a compact disc package or a cassette package.

3. A hand held device for opening a selected one of two flat shrink-wrapped packages each of rectangular configuration and respectively different predetermined thicknesses, each package being characterized by a side wall having a longitudinal edge, an openable lid that closes against the longitudinal edge of the side wall, and a shrink wrapping enclosing the entire package, wherein the shrink wrapping includes a sheet member covering the juncture of the lid and the side wall edge, said device comprising:

a plastic block having elongated slots in two opposite sides which define a central wall portion therebetween, each slot having a bottom surface formed by the central wall portion and the bottom surface of each slot being essentially a flat plane, each slot having an open side opposite said bottom surface and an associated pair of side walls extending away from said central wall portion to a respective one of said opposite sides, said side walls being in a spaced parallel relationship;

each of said slots being of uniform width for slidably receiving a side of a respective one of said shrink-wrapped packages in close-fitting engagement therewith whereby the associated package may be slid longitudinally therethrough;

each of said slots having a respectively associated cutting blade secured in said bottom surface and extending parallel to the associated side walls of said slot for making a length-wise cut through the sheet member of the shrink wrapping; and each of the cutting blades being in a laterally offset position in its associated slot and extending from said bottom surface to slightly enter the otherwise closed juncture of the lid and the longitudinal edge of the side wall of the selected package and thereby easily guide the blade to make an uninterrupted incision in the shrink wrapping through the entire length of the package.

4. The hand held device as in claim 3 wherein the cutting edges of the two blades are oriented longitudinally of their respective slots but in opposing directions therein.

5. The hand held device as in claim 3 wherein a third side includes a surface having recesses therein for finger gripping purposes, and a fourth side opposite said third side and having an essentially flat surface, the third and fourth sides being essentially parallel to both of said elongated slots, whereby the user of the device may very easily avoid two wrong positions for holding the device, and a choice can then be made between the feasible positions depending upon whether the shrink-wrapped package to be opened is a compact disc package or a cassette package.

6. The hand held device as in claim 5 wherein the cutting edges of the two blades are oriented longitudinally of their respective slots but in opposing directions therein.

* * * * *